United States Patent [19]

Heimberger

[11] 4,152,813

[45] May 8, 1979

[54] SLIDE FASTENER WITH SEPARABLE END MEMBERS

[75] Inventor: Helmut Heimberger, Locarno, Switzerland

[73] Assignee: Optilon W. Erich Heilmann GmbH, Cham, Switzerland

[21] Appl. No.: 804,147

[22] Filed: Jun. 6, 1977

[30] Foreign Application Priority Data

Jun. 23, 1976 [DE] Fed. Rep. of Germany ..... 2628165
Oct. 6, 1976 [DE] Fed. Rep. of Germany ..... 2644965

[51] Int. Cl.[2] ..... A44B 19/36
[52] U.S. Cl. ..... 24/205.11 F; 24/205.11 R
[58] Field of Search ..... 24/205.11 F, 205.11 R

[56] References Cited

U.S. PATENT DOCUMENTS

| | | | |
|---|---|---|---|
| 2,553,230 | 5/1951 | Bashover | 24/205.11 R |
| 3,104,438 | 9/1963 | Scarpini | 24/205.11 F |
| 3,353,233 | 11/1967 | Frohlich | 24/205.11 F |
| 3,872,551 | 3/1975 | Moertel | 24/205.11 R |
| 3,892,017 | 7/1975 | Watson | 24/205.11 F |

FOREIGN PATENT DOCUMENTS

| | | | |
|---|---|---|---|
| 739 | 2/1936 | Australia | 24/205.11 R |
| 480519 | 1/1952 | Canada | 24/205.11 R |
| 2341351 | 3/1975 | Fed. Rep. of Germany | 24/205.11 R |
| 1092449 | 4/1955 | France | 24/205.11 R |
| 47820 | 8/1969 | German Democratic Rep. | 24/205.11 |
| 542748 | 5/1956 | Italy | 24/205.11 R |

*Primary Examiner*—Bernard A. Gelak
*Attorney, Agent, or Firm*—Karl F. Ross

[57] ABSTRACT

A slide fastener with separable end stop members including an insertion member and a reception member each associated with a respective row of coupling elements on a stringer half. The members have complementary offset steps orthogonal to the slide fastener plane to prevent relative displacement of these members when they are interfitted in a direction perpendicular to the slide fastener plane and are mutually engageable. A slider of generally Y-shaped channel configuration can be displaced upon the rows of coupling elements to interconnect and disconnect them. The slider has arcuate slider flanks receiving the insertion and reception members between them and these members have arcuate surfaces corresponding to the curvature of these flanks and engageable therewith. An abutment is provided to enable the coupling element to be drawn over one of these members, namely, the reception member, in a unidirectional manner and preventing withdrawal of the slider in the opposite direction. The insertion member is shaped so that it can be fitted into the reception member when the slider is disposed over the latter.

3 Claims, 7 Drawing Figures

FIG. 3
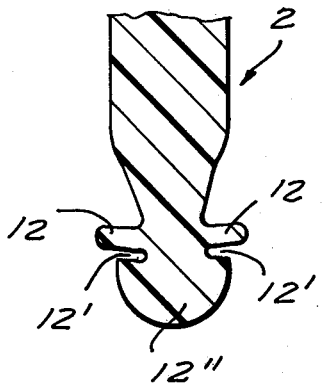
FIG. 4
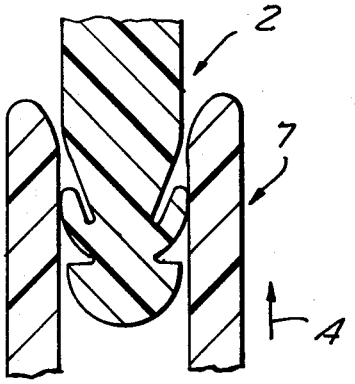
FIG. 5
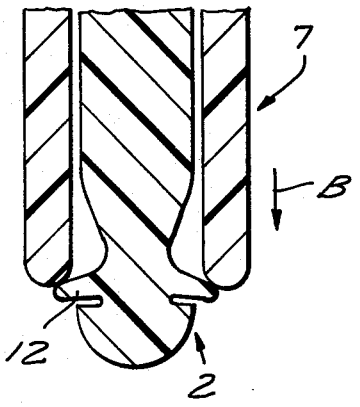
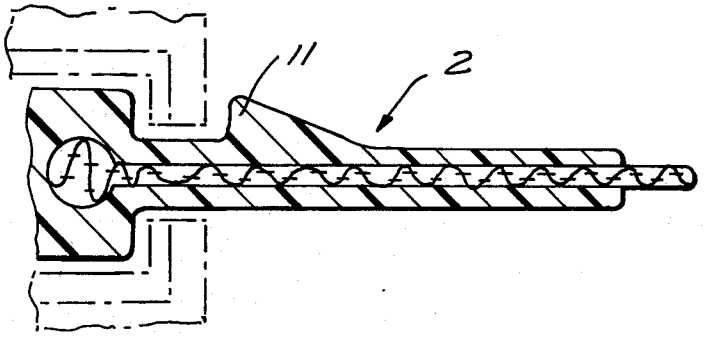
FIG. 6

SLIDE FASTENER WITH SEPARABLE END MEMBERS

FIELD OF THE INVENTION

The present invention relates to a slide fastener with separable end stop members and, more particularly, to a slide fastener having respective rows of coupling elements or heads along juxtaposed edges of stringer halves and, at one end of the stringer, an insertion member and are reception member which can be interfitted within a slider to join the members together so that movement of the slider away from these interfitted members couples the elements together.

BACKGROUND OF THE INVENTION

It is known to provide separable end members at one end of a slide fastener stringer, one of these members constituting an insertion member while the other member constitutes a reception member adapted to receive the insertion member when the latter is fed through a corresponding channel of a slider disposed at the reception member.

The slider, which can have a Y-shaped channel configuration, is displaceable along the stringer to interconnect the rows of coupling elements or disconnect the same. The coupling elements may be heads which are spaced apart to receive the heads of the opposing row between them, the heads being part of a continuous coupling coil or meander, or being discrete coupling heads mounted, e.g. by molding, upon an edge of a respective support tape. One end member, the respective row of coupling elements or heads, and the support tape carrying same constitute a respective stringer half. Two such stringer halves and an associated slider constitute a slide fastener stringer in accordance with the present invention.

The straight leg of the channel of the slider is generally dimensioned so that its width is less than twice the lengths of the coupling elements so that the latter are drawn together and forced between the coupling elements of the opposing row as the two rows of coupling elements pass through the convergent legs of the channel to the aforementioned straight portion thereof.

The slider may also have flanks which receive the end stop members between them or at least portions of these end stop members.

In conventional slide fasterner stringers of the aforedescribed type, the insertion member forms a so-called plug while the reception member is constituted as a socket receiving the plug. The end members, upon separation, permit the slider to remain upon the reception member or socket after the insertion member or plug is withdrawn to permit the normally juxtaposed edges of the stringer to be spread apart. Typical use of such a slide fastener stringer is in a jacket or garment which is to be fully opened.

In the closed condition of the slide fastener, however, the plug remains locked in the socket and the slider is in the position remote from these end members which also serve to prevent the slider from being withdrawn fully from the stringer. In this position, the coupling elements of the two rows between the slider and the end members are interfitted or interdigitated with the heads of the coupling elements of one row being received between the heads of the coupling elements of the other row and vice versa.

There are, however, also slide fastener stringers known in which the plug-and-socket relationship is not used and which nevertheless permit separation of the end members. Reference is made in this connection to the open German application (Offenlegungsschrift) DT-OS No. 25 10 098.

In this case, the end members mutually engage without either being formed with a box-like socket or housing and without the other being constituted as a plug which is wholly enclosed within such a housing-shaped socket. In this arrangement, the insertion member engages the reception member and the two members are formed, transversely to the slide fastener plane, with an offset step which permits form-fitting engagement and nevetheless precludes transverse dislocation of the interengaged end stop members.

In this construction, however, the insertion member as well as the reception member have straight flanks which confront the flanks of the slider between which the two members are received.

As a consequence, when the slider is not fully in a position enclosing the reception member, the insertion member cannot be introduced with ease and hence there is encountered difficulty with introduction of the insertion member in the reception member of engagement of the two upon closing of the slide fastener.

Because of these difficulties, the manipulation of the end members and the slide during closing and during disengagement (separation of the stringer halves) is difficult. Finally, this construction does not readily permit automatic drawing of the slider onto the stringer, i.e. automatic or trouble-free mounting of the slider in assembly of the stringer.

OBJECTS OF THE INVENTION

It is an object of the present invention to provide a slide fastener stringer consisting of a pair of slide fastener halves and associated slider, with a pair of separable end members which obviate the disadvantages discussed above.

It is another object of the invention to provide a slide fastener which facilitates the joining of the end members as well as the separation thereof for closing and opening, respectively, of the slide fastener.

It is yet another object of the invention to provide separable end members without the disadvantages enumerated above and which permit, with very simple manipulation, the engagement and disengagement (connection and disconnection) of the stringer halves and at the same time permit of automatic mounting of the slider on the stringer.

SUMMARY OF THE INVENTION

These objects and others which will become apparent hereinafter are attained, in accordance with the present invention, in a slide fastener having a pair of end members including an insertion member and a reception member which, while generally of the type described in the aforementioned German Offenlegungsschrift, have, in addition, concave outwardly facing flanks which confront the flanks of the slider and have curvatures which correspond to the curvatures of the slider flanks to facilitate the introduction of the insertion member into the slider and the reception member and also permit or facilitate drawing of the slider onto the reception member in assembly of the slide fastener.

According to an important feature of the invention, the reception member is formed with a slider-positioning element which retains the slider in its end position.

More specifically, a slide fastener stringer in accordance with the present invention comprises a pair of stringer halves, each having a support tape and formed with a row of spaced-apart coupling elements or heads along an edge of this tape confronting the edge of the opposing tape. At one end of each row of coupling elements or heads, there is provided a respective end member, the end member of one tape being constituted as an insertion member while the end member of the other tape is constituted as a reception member form-fittingly engaging the insertion member when the latter is introduced into the reception member. To this end, each of the members may be formed with a finger and a recess so that the finger of one member fits into the recess of the other. These fingers may be arcuate to permit arcuate introduction of the insertion member into the reception member as described, i.e. by movement of the insertion member along an arcuate path corresponding to the arcuate flank of the slider.

The slider, which can be drawn over the reception member and onto the stringer, is provided with a generally Y-shaped channel configuration through which the coupling elements are guided convergingly through the arms of the Y into mutual engagement within the leg of the latter, the outer sides of the channel configuration being defined by the arcuate slider flanks which cooperate with the arcuate flanks of the insertion and reception members described above. The "flanks" of the insertion and reception members are those surfaces of the members which face away from one another, i.e. are the backs of these members.

According to a feature of the invention, the two members are provided with complementary offset transverse steps which fit together to prevent relative transverse displacement of the members, i.e. relative displacement in a direction perpendicular to the slide fastener plane.

According to another feature of the invention, the positioning element can also form a guide element which enables mounting of the slider in a convenient and accurate manner.

The slider need not be held in its end position solely by the positioning element. To this end, the invention provides means for statically retaining the slider in this end position in addition to the aforementioned positioning means, the stop or abutment means being formed at the lower end of the reception member, i.e the end of the reception member turned away from the respective row of coupling elements or heads.

The latter abutment is preferably formed as a unidirectionally deformable portion which can be deflected by the slider as the latter is drawn onto the stringer and which springs back to prevent withdrawal of the slider in the opposite direction. This unidirectionally effective member, the positioning element and the various formations of the reception member can be formed unitarily and integrally by injection molding on the one end stop. The other end stop can be unitarily injection-molded with the curved rear flank as well as the aforementioned finger end stop which engages a corresponding or complementary finger of the reception member as described. The members described previously, therefore, can be entirely injection-molded from synthetic resin as can the coupling elements or heads. The molded bodies can be formed directly on corresponding edges of the respective support tapes.

The system of the present invention will be found to have several important advantages. Firstly, the slider is accurately positioned in its end location so that introduction and withdrawal of the insertion member into the reception member and out of the latter is greatly facilitated. Furthermore, the slider can be drawn with ease over the reception member in assembly of the slide fastener and, in addition, the slider is prevented from being withdrawn from the stringer past the abutment of the reception member.

The arcuate rear surface of the insertion member, guided by the corresponding arcuate flank of the slider channel into which it is fitted, when the slider is accurately positioned by the positioning element upon the reception member, ensures accurate engagement of the insertion member and the reception member and proper mutual disposition of the offset steps.

BRIEF DESCRIPTION OF THE DRAWING

The above and other objects, features and advantages of the present invention will become more readily apparent from the following description, reference being made to the accompanying diagrammatic drawing in which:

FIG. 1A is a section taken along the line IA—IA of FIG. 1;

FIG. 3 is an enlarged cross-sectional view taken along the line III—III of FIG. 1;

FIG. 4 is a view similar to FIG. 3 but illustrating the condition of the abutment means illustrated therein upon mounting of the slider;

FIG. 5 is another view of the structure illustrated in FIG. 3 but after the slider has been fully mounted; and FIG. 6 is a section taken along the line VI—VI of FIG. 1.

SPECIFIC DESCRIPTION

Figure 1:
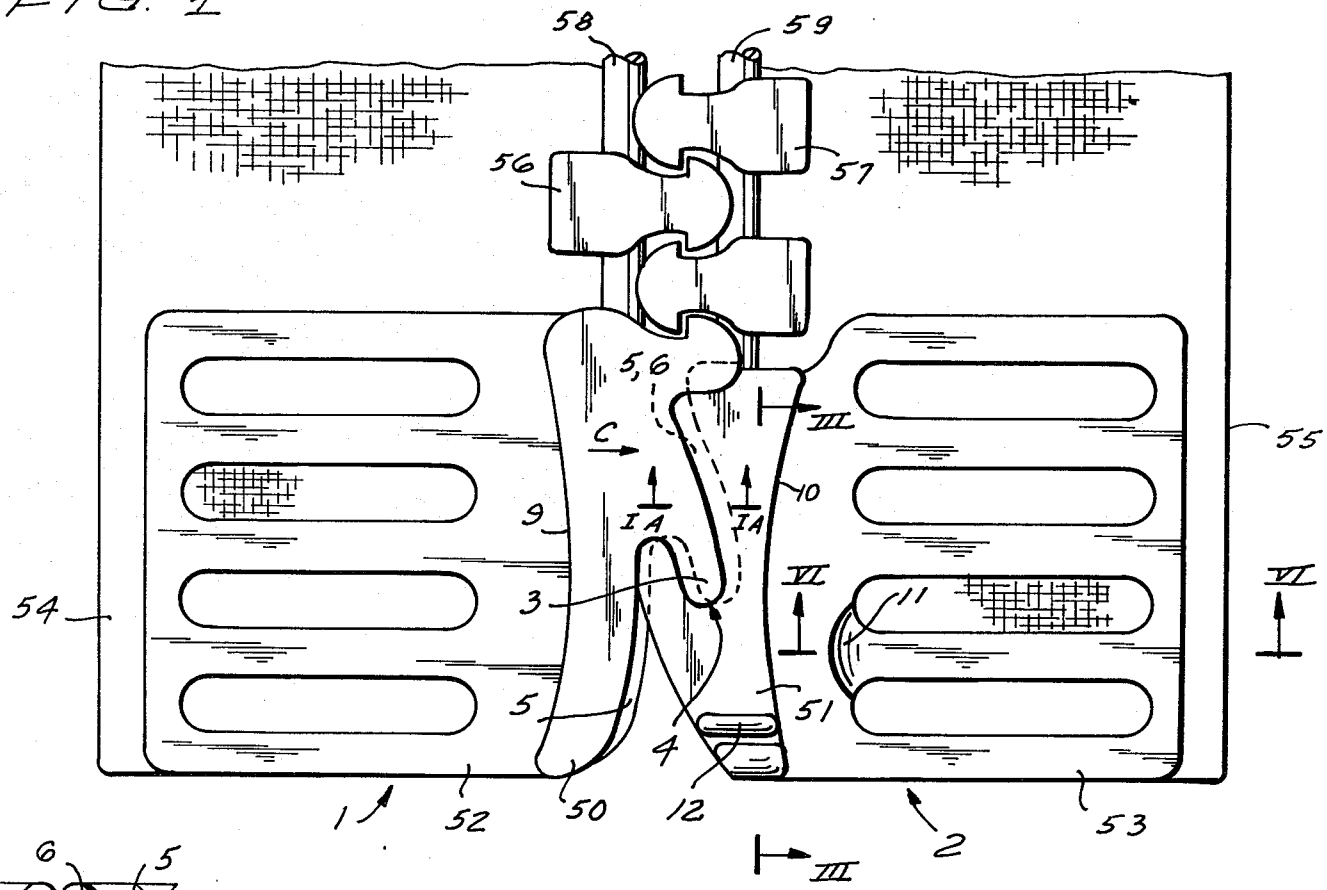
FIG. 1 shows the lower end of a slide fastener according to the invention with the end members in their coupled condition in plan view.
Figure 14:
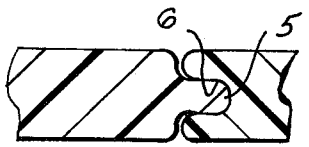

In its basic construction, a slide fastener according to the invention comprises a pair of end members 1, 2 molded onto respective support tapes 54 and 55 and each comprising a plate portion 52 or 53 which is formed with a ridge portion 50 and 51, the latter having the interfitting formations 3 and 4 which enable the insertion member 1 to be introduced into the reception member 2. The slide fastener stringer further comprises respective rows of molded coupling heads 56 and 57 disposed along beaded edges 58 and 59 of the respective support tapes. The slider 7 which is used with the stringer of FIGS. 1 and 2 and with the other stringers shown, comprises a lower shield 60 and an upper shield which has not been shown but which is shown with the arcuate flanks 8 and which define a Y-shaped channel having a pair of downwardly convergent or upwardly divergent arms 61 and 62 and a common leg 63. The upper and lower shields are joined by a core or heart piece (wedge) 64 in accordance with usual practice.

More particularly, the slide fastener of the present invention (see FIGS. 1 through 6) comprises an insertion member 1 and a reception member 2 which can be joined together or separated. To this end, the insertion member 1 is provided with a coupling element in the form of a coupling nose or finger 3 which is somewhat curved as illustrated clearly in FIGS. 1 and 2 to permit arcuate insertion of this nose or finger 3 in the direction of the arcuate arrow 13 into a complementary coupling pocket or recess 4. Of course, the pocket can be provided on the insertion member and the finger or coupling nose upon the reception member if desired.

Figure 2:
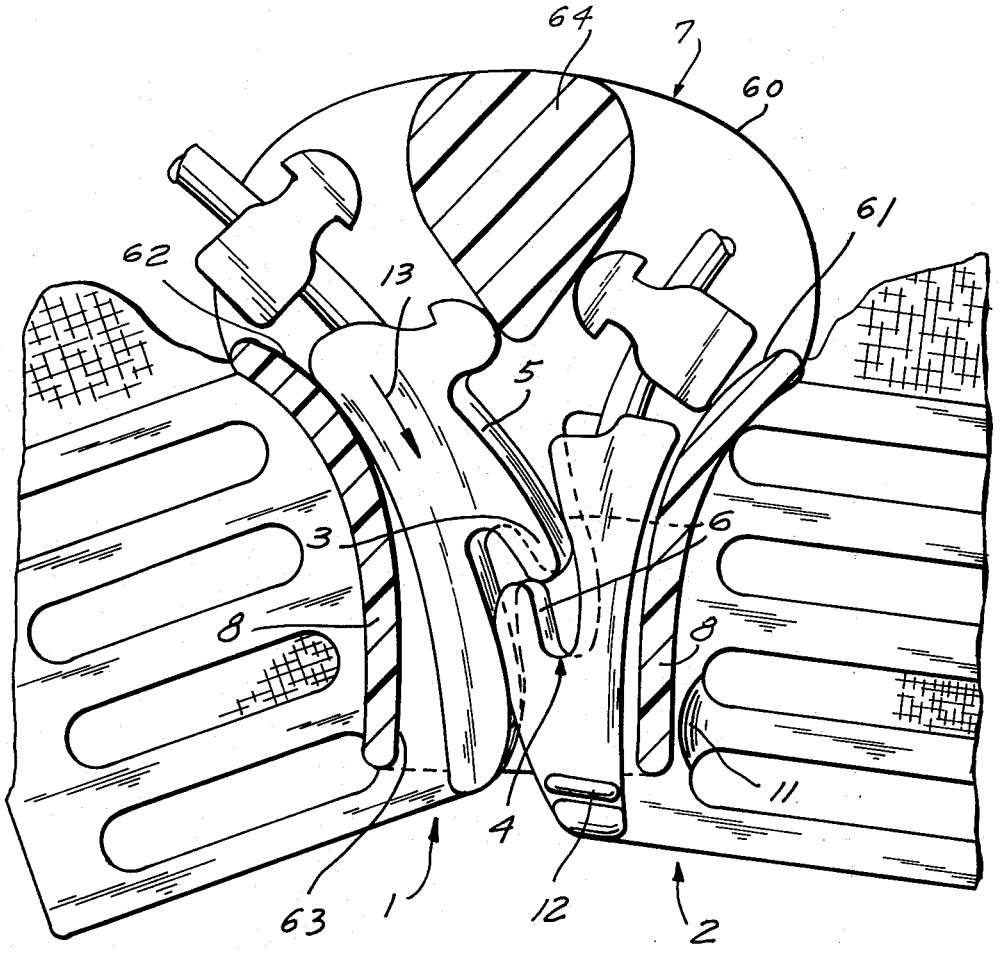
FIG. 2 is a view similar to FIG. 1 but illustrating the act of introduction of the insertion member into the reception member and slider.
Figure 7:
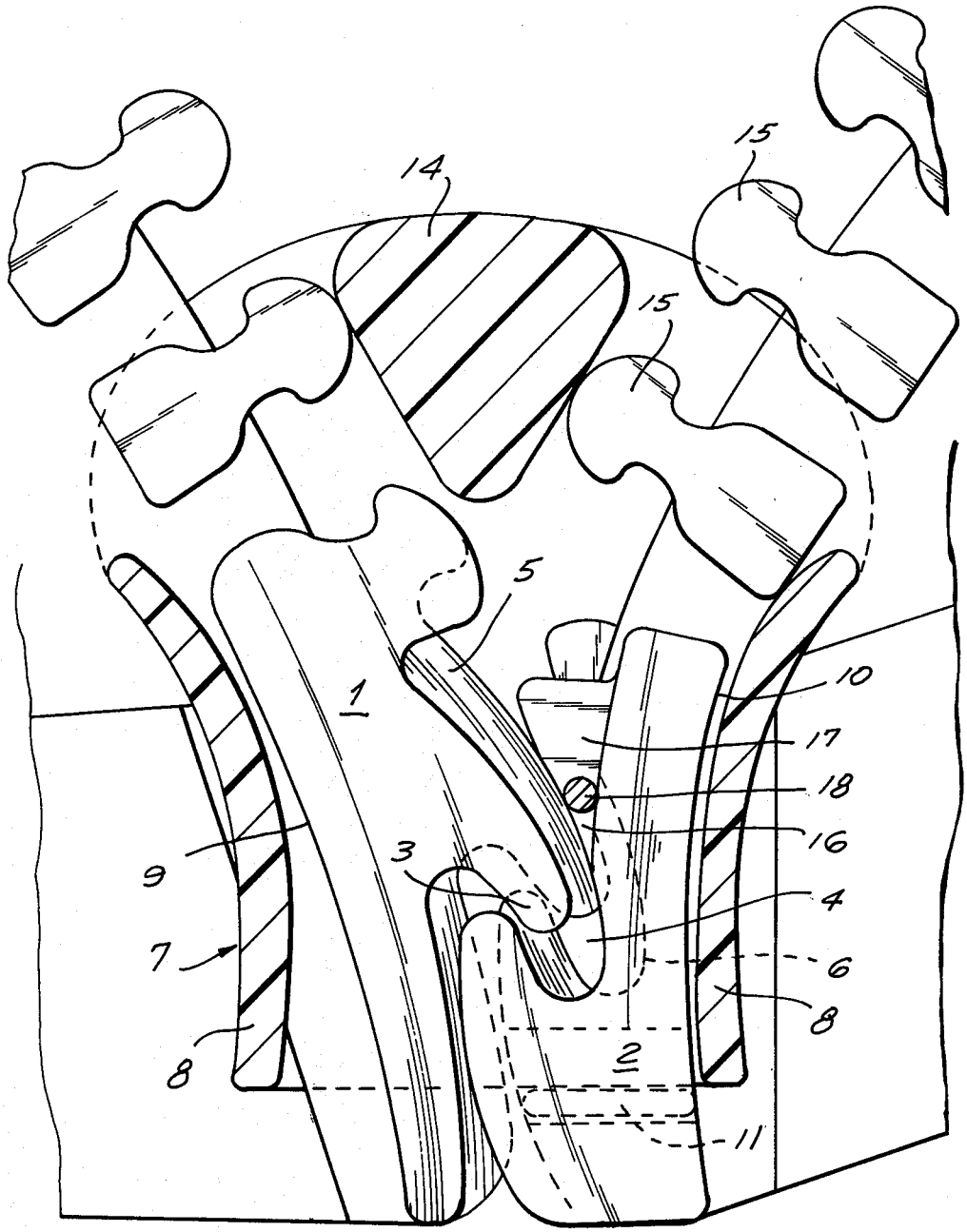
Figure 8:
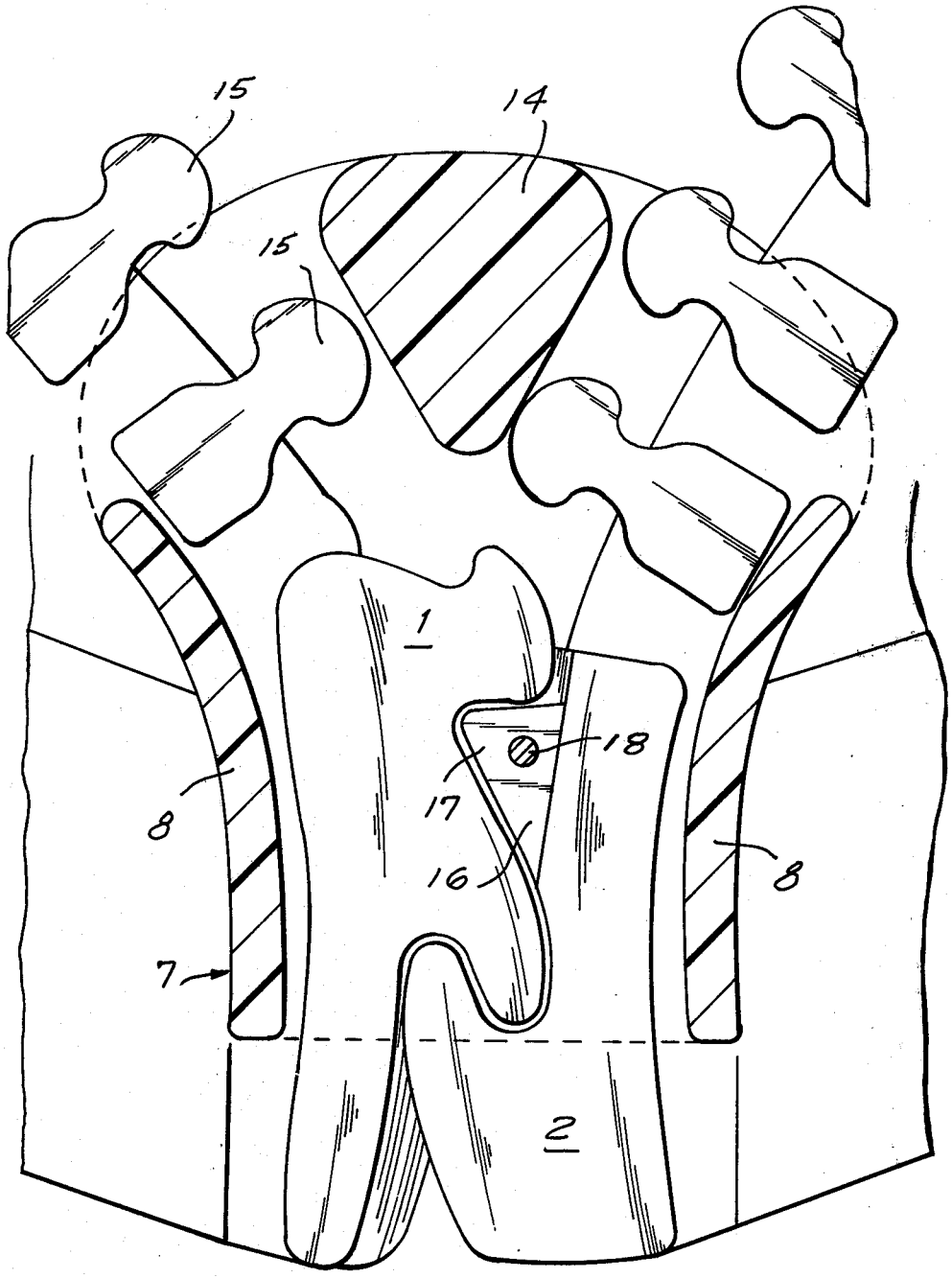
Figure 9:
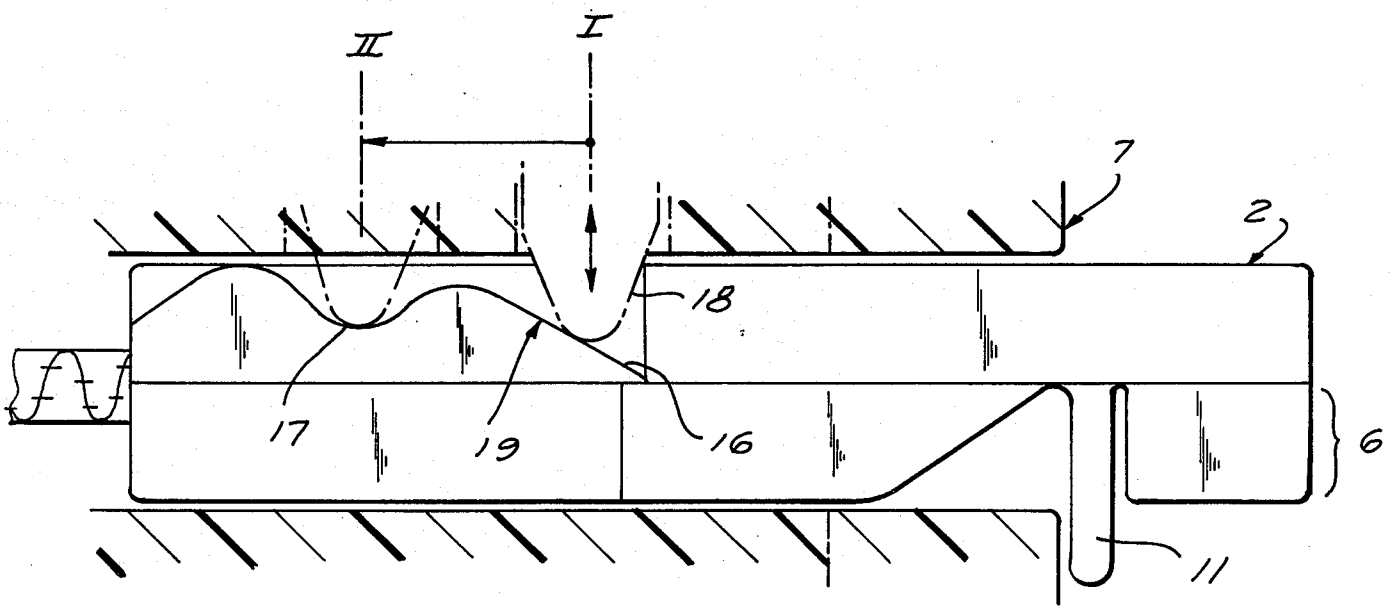

As can be seen from FIGS. 1, 2 and 1A, the members 1 and 2 are so constructed that they engage, in addition, via complementary offset steps 5 and 6 orthogonal to the slide fastener plane, i.e. the plane of the paper in FIG. 1. Hence, upon interengagement of the end members 1 and 2, transverse dislocation, i.e. relative separation in a direction perpendicular to the plane of the slide fastener, is obviated.

As has also been indicated, the insertion member 1 and the reception member 2 are receivable in the slider 7 which has a wire-shaped channel configuration and correspondingly curved slide fastener flanks 8 which extend downwardly from the upper shield and upwardly from the lower shiled, respectively.

According to an important feature of the invention, the insertion member 1 and the reception member 2 have rear flanks 9 and 10 facing and engaging the curved slider flanks 8.

The curvatures of these back flanks 9 and 10 correspond to the radius of curvature of the slider flanks 8.

The reception member 2 is provided, in addition to the ridge formation 51, previously described, with a positioning element 11 in the form of an upwardly curved protuberance (see FIGS. 1, 2 and 6) designed to retain the slider 7 in its end position as illustrated in FIG. 2, i.e. to accurately hold the slider in place during introduction of the insertion member 1 therein.

At its lower end, the reception member 2 is also provided with a slider abutment 12 which has a special configuration as illustrated in FIGS. 3 through 5.

Thus, the member 2 can be formed with upwardly and downwardly projecting flanges 12 ahead of a pair of shoulders 12" formed on the lower end 12" of the reception member 2. As a consequence, the slider abutment constitutes a unidirectional detent which permits of deflection away from the shoulder 12' upon insertion of the slider over the reception member 2 as illustrated in FIG. 4, the slider being moved in the direction of arrow A.

Once the slider has been fully drawn over the flanges 12, the latter spring back to their original position (FIG. 5) and shoulders 12' support the flanges against movement of the slider in the direction of arrow B, i.e. in the direction tending to withdraw the slider from the reception member 2. As a consequence, the slider can be readily drawn over the reception member in the position of the assembly illustrated, for example, in FIG. 1 or can be drawn over only the reception member 2 when the insertion member 1 is released therefrom.

Upon movement of the slider into its end position (FIG. 2), the insertion member 1 can be introduced into the channel 62 of the slider 7 in the direction of the arrow 13, the back surface 9 riding along the inner face of the flanks 8.

I claim:

1. In a slide fastener having a pair of support tapes each provided with a row of interdigitable coupling heads, respective end stop members at corresponding ends of the respective row, and a slider shiftable along said rows to connect and disconnect said rows of heads, and wherein, further, said end stop members engage one another in a connected condition with line contact, one of said end stop members being constituted as an insertion member having a nose turned away from the respective row of heads, the other end stop member being constituted as a reception member and formed with a hook open toward the respective row of heads and adapted to receive said nose, the improvement wherein:

said end stop members are provided over the entire length of their line of contact with mutually engaging steps for guiding said nose into said hook and positioning said end stop members in a connected condition;

said insertion member is provided with a curved rear flank concave away from said nose and engageable with a convexly curved surface of said slider for enabling said insertion member to be guided by said slider into engagement with said reception member when said slider is on said reception member;

said reception member has a rear flank concave away from said hook;

said reception member is provided with a position element spaced laterally from its rear flank and adapted to engage said slider when said slider is positioned on said reception member; and an abutment is formed on said reception member in the path of said slider upon its movement away from said row and below said hook to restrict withdrawal of said slider from said fastener.

2. The slide fastener defined in claim 1 along said abutment is formed with a ramp rising in the direction of said hook and with a steep flank at the end of said ramp enabling insertion of said slider over said abutment and onto said reception member but preventing withdrawal of said slider therefrom.

3. The slide fastener defined in claim 1 wherein said abutment is a formation of upstanding from said reception member and deflectable by said slider in one direction to enable said slider to be drawn onto said reception member but preventing withdrawal of said slider past said abutment.

* * * * *